US005668521A

United States Patent [19]

Oh

[11] Patent Number: 5,668,521

[45] Date of Patent: Sep. 16, 1997

[54] THREE PIECE FEMALE BLADE FUSE ASSEMBLY HAVING FUSE LINK TERMINAL WITH A CLIP RECEIVING PORTION

[75] Inventor: Seibang Oh, Elk Grove Village, Ill.

[73] Assignee: Littelfuse, Inc., Des Plaines, Ill.

[21] Appl. No.: 408,473

[22] Filed: Mar. 22, 1995

[51] Int. Cl.[6] ..... H01H 85/02

[52] U.S. Cl. ..... 337/186; 337/255; 337/260; 337/197; 337/227

[58] Field of Search ..... 337/198, 186, 337/163, 166, 264, 227, 255, 260, 297, 197; 439/621, 622; 29/623

[56] References Cited

U.S. PATENT DOCUMENTS

| | | | |
|---|---|---|---|
| Re. 33,137 | 12/1989 | Gurevich et al. | 337/255 |
| 2,774,951 | 12/1956 | Kinkaid et al. | 339/258 |
| 2,903,539 | 9/1959 | Matthysse et al. | 200/129 |
| 2,921,287 | 1/1960 | Matthysse et al. | 339/258 |
| 2,996,026 | 8/1961 | Batcheller | 113/119 |
| 3,139,318 | 6/1964 | Binder et al. | 339/258 |
| 3,148,257 | 9/1964 | Feenan et al. | 200/135 |
| 3,288,968 | 11/1966 | Feenan et al. | 200/135 |
| 3,409,867 | 11/1968 | Lessner | 339/258 |
| 3,524,157 | 8/1970 | Salzer | 337/159 |
| 3,550,069 | 12/1970 | Teagno et al. | 339/256 |
| 3,813,626 | 5/1974 | Cetola et al. | 337/245 |
| 3,995,929 | 12/1976 | Ghirardi et al. | 339/32 |
| 4,099,320 | 7/1978 | Schmidt, Jr. et al. | 29/623 |
| 4,131,869 | 12/1978 | Schmidt, Jr. et al. | 337/264 |
| 4,196,409 | 4/1980 | Juba | 337/198 |
| 4,253,080 | 2/1981 | Howard | 337/159 |
| 4,297,666 | 10/1981 | Asdollahi | 337/163 |

(List continued on next page.)

FOREIGN PATENT DOCUMENTS

| | | |
|---|---|---|
| 228490A 1 | 7/1987 | European Pat. Off. . |
| 633592A 1 | 1/1995 | European Pat. Off. . |
| 1312116 | 11/1962 | France . |
| 1567727 | 5/1969 | France . |
| 1615002 | 5/1970 | Germany . |
| 2517069 | 10/1976 | Germany . |
| 2714797 | 2/1979 | Germany . |
| 4340979A1 | 7/1994 | Germany . |
| 720592 | 3/1980 | Greece . |
| 626449 | 10/1961 | Italy . |
| 56-53 | 1/1981 | Japan . |
| 57-151141 | 9/1982 | Japan . |
| 57-210537 | 12/1982 | Japan . |
| 59-16054 | 1/1984 | Japan . |
| 59-178857 | 11/1984 | Japan . |
| 60-177527 | 9/1985 | Japan . |
| 61-61331 | 3/1986 | Japan . |
| 61-166449 | 10/1986 | Japan . |
| 61-166450 | 10/1986 | Japan . |
| 61-240521 | 10/1986 | Japan . |
| 61-271731 | 12/1986 | Japan . |
| 61-294730 | 12/1986 | Japan . |

(List continued on next page.)

*Primary Examiner*—Leo P. Picard
*Assistant Examiner*—Jayprakash N. Gandhi
*Attorney, Agent, or Firm*—Wallenstein & Wagner, Ltd.

[57] ABSTRACT

A female fuse assembly has a fuse housing, and first and second fuse-link terminals. Each fuse-link terminal includes a clip-receiving portion, and first and second clip abutments. The female fuse assembly also includes a fuse link connected between the first and second fuse-link terminals. The first and second female clips each include a clip body for operative engagement with the respective first and second fuse-link terminals. The first and second clips each also including first and second arm-connecting extensions, and first and second arms. The first and second arm-connecting extensions of the first clip are engaged with the respective first and second clip abutments of the first and second fuse-link terminals. The first and second arms of each first and second clip each have a first and a second branch. The first branches of the first and second arms of the first and second clips engage the respective first and second fuse-link terminals, and second branches of the first and second arms of the first and second clips engage a contacting surface of a male terminal to secure a snug fit between the male terminals, the fuse-link terminals, and the clips.

19 Claims, 2 Drawing Sheets

U.S. PATENT DOCUMENTS

| | | | |
|---|---|---|---|
| 4,310,719 | 1/1982 | Cross et al. | 174/94 R |
| 4,319,213 | 3/1982 | Reid | 337/161 |
| 4,344,060 | 8/1982 | Ciesemier et al. | 337/260 |
| 4,417,225 | 11/1983 | Muller et al. | 337/198 |
| 4,544,907 | 10/1985 | Takano | 337/262 |
| 4,570,147 | 2/1986 | Ebi | 337/166 |
| 4,604,602 | 8/1986 | Borzoni | 337/264 |
| 4,612,529 | 9/1986 | Gurevich et al. | 337/255 |
| 4,635,023 | 1/1987 | Oh | 337/163 |
| 4,646,052 | 2/1987 | Matsunaga et al. | 337/166 |
| 4,661,793 | 4/1987 | Borzoni | 337/260 |
| 4,670,729 | 6/1987 | Oh | 337/264 |
| 4,672,352 | 6/1987 | Takano | 337/264 |
| 4,685,754 | 8/1987 | Coldren | 439/270 |
| 4,691,981 | 9/1987 | Coldren | 439/816 |
| 4,751,490 | 6/1988 | Hatagishi | 337/295 |
| 4,764,133 | 8/1988 | Kaneko | 439/889 |
| 4,781,628 | 11/1988 | Detter et al. | 439/748 |
| 4,800,358 | 1/1989 | Takenouchi et al. | 337/268 |
| 4,808,962 | 2/1989 | Ikeda | 337/203 |
| 4,810,215 | 3/1989 | Kaneko | 439/845 |
| 4,869,972 | 9/1989 | Hatagishi | 428/647 |
| 4,871,990 | 10/1989 | Ikeda et al. | 337/238 |
| 4,944,084 | 7/1990 | Horibe et al. | 29/623 |
| 4,944,697 | 7/1990 | Dorman | 439/621 |
| 4,958,426 | 9/1990 | Endo et al. | 29/623 |
| 4,975,551 | 12/1990 | Syvertson | 200/144 |
| 4,988,969 | 1/1991 | Gurevich | 337/260 |
| 5,091,712 | 2/1992 | Suuronen | 337/297 |
| 5,139,443 | 8/1992 | Armando | 439/620 |
| 5,147,230 | 9/1992 | Plyler et al. | 439/843 |
| 5,181,866 | 1/1993 | Jerome et al. | 439/850 |
| 5,229,739 | 7/1993 | Oh et al. | 337/290 |
| 5,262,751 | 11/1993 | Kudo et al. | 337/296 |
| 5,281,175 | 1/1994 | Chupak et al. | 439/839 |
| 5,293,147 | 3/1994 | Oh et al. | 337/227 |
| 5,294,906 | 3/1994 | Totsuka et al. | 337/260 |
| 5,346,411 | 9/1994 | Nikkinen | 439/621 |
| 5,350,321 | 9/1994 | Takenouchi | 439/839 |
| 5,357,234 | 10/1994 | Pimpis et al. | 337/246 |
| 5,361,058 | 11/1994 | Mosesian et al. | 337/163 |
| 5,374,590 | 12/1994 | Batdorf et al. | 437/173 |

FOREIGN PATENT DOCUMENTS

| | | |
|---|---|---|
| 64-60937 | 3/1989 | Japan . |
| 1-241728 | 9/1989 | Japan . |
| 1-241729 | 9/1989 | Japan . |
| 1-315924 | 12/1989 | Japan . |
| 2-66828 | 6/1990 | Japan . |
| 2-89753 | 7/1990 | Japan . |
| 2-499735 | 8/1990 | Japan . |
| 5-172050 | 7/1993 | Japan . |
| 5-205608 | 8/1993 | Japan . |
| 5-274995 | 10/1993 | Japan . |
| 6-13043 | 2/1994 | Japan . |
| 6-48149 | 6/1994 | Japan . |
| 858115 | 1/1961 | United Kingdom . |
| 2197759 | 5/1988 | United Kingdom . |

THREE PIECE FEMALE BLADE FUSE ASSEMBLY HAVING FUSE LINK TERMINAL WITH A CLIP RECEIVING PORTION

TECHNICAL FIELD

The present invention relates generally to electrical fuses. More particularly, this invention relates to female electrical fuses which are designed for connection into a fuse block having male terminal connections.

BACKGROUND PRIOR ART

Automobile and other female fuse assemblies commonly comprise a two-piece assembly heretofore having a box-like housing and an all metal female one-piece fuse element secured therein. The metal female fuse element has a pair of spaced apart female terminals which are accessible from one end of the housing. The female terminals are closely encompassed by the housing walls. A fuse link unsupported between the ends thereof extends suspended between the extensions of the female terminals. The fuse link is spaced from the housing side walls which are closely spaced from the fuse link. A low fusing point metal is typically attached to the fuse link. The housing has slot-like openings at one end of the housing, and the female terminals are accessible from these slot-like openings where male blade-type terminals can be plugged into the female terminals. These male blade-type conductors typically extend from mounting panel or fuse block. This type of one-piece female fuse element and method of making the same are described in U.S. Pat. Nos. 4,570,147, 4,751,490, 4,958,426 and 4,344,060.

Automobile and other female fuse assemblies also have included an all metal female three-piece fuse element in place of a one-piece fuse element. As in the previously mentioned female fuses, the metal female fuse element has a pair of spaced apart female terminals which are accessible from one end of the housing. However, the female terminals can be created from typical male terminals by adding female sockets to the male terminals instead of forming the complete female fuse element from one piece. This structure and method of making the same are described in U.S. Pat. Nos. 4,672,352, and 4,869,972.

There are several constraints which exist when working with a one-piece female fuse construction. For example, the stiffness or resilience (spring qualities) of the fuse element material as well as the conductivity of the fuse element material both become important factors in determining the materials to be used. It is clear that the conductivity of the material is important due to principle that unnecessary resistance will reduce the amount of current flowing through the fuse. The resilience of the material is also important because the female engagement portion of the female fuse element must be durable and spring-like in order to continuously grip the male terminals on the terminal block in a snug manner. The resiliency is also a factor due to gravitational forces exerted on the fuse element when current heats up the fuse element (See U.S. Pat. No. 4,635,023). Other factors are involved, as well, in choosing the material to be used. Thus, at least both conductivity and resiliency are important factors. However, choosing a material to satisfy one factor will often not satisfy the other factor and trade-offs must be made with respect to such factors.

When a designer designs a proper construction for a three-piece fuse, the designer can choose materials for the fuse element which are different from the materials of the female sockets. Specifically, when a proper deign is chosen, the designer can choose a material for the fuse element which will allow for suitable conductivity, while at the same time the designer can choose a different material for the female sockets which will provide ample resilience to effect a snug fit between the fuse element, the sockets, and male terminals inserted therein. A snug fit will keep the resistance low (i.e. loss of current low) between the terminals of the fuse element and male terminals connected or linked thereto by the sockets. A snug fit only exists if there is no movement between the fuse element, the sockets, and male terminals inserted therein. These elements, snugly fit together, should also remain still, relative to their housing, to prevent the snug fit from being broken by any movement between these elements. If the fit between the fuse element, the sockets, and the male terminals inserted therein does not remain snug over time, the resistance therebetween, and the loss of current created therefrom, will be unsatisfactory for prolonged commercial use.

Specifically, although U.S. Pat. No. 4,869,972 (Hatagishi) discloses a three-piece female fuse configuration, this patent does not disclose a configuration that lends itself to a prolonged snug fit. The female sockets from this patent is only disclosed as being used for testing. In addition, if this configuration was placed in a commercial environment (i.e. onto a male fuse block within an automobile), small vibrations in the commercial environment would cause the fit between the fuse element, the sockets, and male terminals inserted therein to move about and loosen. No features are shown to lock or create a fit which can be completely snug. Without a snug fit, movement between these elements would cause a higher resistance within the fit, thereby causing a loss of current as well as unwanted heating of the fuse connections near the fuse block.

U.S. Pat. No. 4,672,352 also discloses a three-piece fuse assembly which includes a fuse element, tab insertion sockets (sockets), and a housing to house the same. The focus of the patent is that the fuse element can be replaced without replacing the sockets or housing. Thus, construction of the housing allows for the fuse element to be removed without removing the sockets. This construction also does not have any kind of firm fit of the sockets or fuse element within the housing unless a male terminal is inserted therein to force these elements outward from the male terminal. In addition, the fuse element in not secured to the socket in any way. The sockets are secured to the housing separate from the fuse element being secured to the housing. If the fuse terminal moves within the housing, not only will the fuse element move in relation to the housing, the fuse element will also move in relation to the sockets therein. Movement of the fuse element would also likely take place relative to the male terminal as well. Likewise, if the socket moves within the housing, the socket will not only move in relation to the housing, the socket will also move in relation to the fuse element. Movement of the socket will also likely take place relative to the male terminal as well. All of these possibilities of movement of the elements within the housing increases the probability of an increase of resistance and a loss of current.

The present invention is provided to solve these and other problems.

SUMMARY OF THE INVENTION

The present invention is a female fuse assembly for enhancing the connections and conductive contacting within a circuit including the female fuse assembly. Generally the female fuse assembly will interrupt a current flowing through a circuit upon certain high current conditions. The circuit will include male terminals that have opposed contact surfaces which connect to female fuse assembly to conduct current through the circuit.

The female fuse assembly includes a fuse housing, and a first and a second fuse-link terminal. Each fuse-link terminal has a first side and a second opposite side, and is secured in the housing. Each fuse-link terminal also includes a clip-receiving portion, a first clip abutment, and a second clip abutment. A fuse link is connected between the first fuse-link terminal and the second fuse-link terminal. The fuse link includes a first side, a second side, and a fuse blowing portion for interrupting and opening the circuit in an over-current or high current condition.

The fuse assembly also includes a first female clip which has a clip body, a first and a second arm-connecting extension, and a first and a second arm. The first and second arm-connecting extensions of the first clip engage with the respective first and second clip abutments of the first fuse-link terminal, and hold the first clip in place. The first and second arms of the first clip each include a first branch and a second branch. The first branches of the first and second arms of the first clip engage the second side of the first fuse-link terminal to secure a snug fit between the first fuse-link terminal and the first clip. The second branches the first and second arms of the first clip resiliently engaging the contacting surface of the male terminal inserted into the first female clip. The female fuse assembly further includes a second female clip which has the same structure as the first female clip, and has the same structural and operational relationship with the second fuse-link terminal and the male terminal as the first female clip has with the first fuse-link terminal and the male terminal.

The present invention further includes, but is not limited to, the first and second sides of the first and second fuse-link terminals configured to be generally co-planar with the respective first and second sides of the fuse-link terminals. In addition, the first and second clip portions or clips are adapted to each receive a male terminal in a plane parallel to the plane of the first and second fuse-link terminals. In this form of the invention, the first and second clip portions can be an integral part of the respective fuse-link terminals, or can be adapted for attachment to the first and second fuse-link terminals as a separate female clip elements.

Other features and advantages of the invention will be apparent from the following specification taken in conjunction with the following drawing.

BRIEF DESCRIPTION DRAWINGS

DETAILED DESCRIPTION

Figure 3:
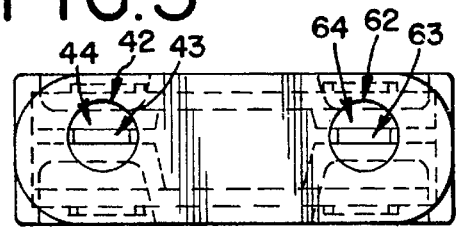
FIG. 3 is a top view of the embodiment of FIG. 1 of the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

FIGS. 1, 2, 3, and 4 show a female fuse assembly for interrupting current flowing through a circuit upon certain high current or over current conditions. Numerous occurrences can cause these types of conditions, as is well known in the art. The female fuse assembly is typically placed within a circuit to perform these functions. Specifically, the circuit includes male terminals 50 (FIG. 2) which typically are a part of a male terminal block or fuse block (not shown) for inserting the female fuse assembly onto the male terminal block. Each male terminal 50 has opposed contact surfaces 51, 52 for conductively connecting the female fuse assembly to the rest of the circuit, as will be described in detail below.

Figure 1:
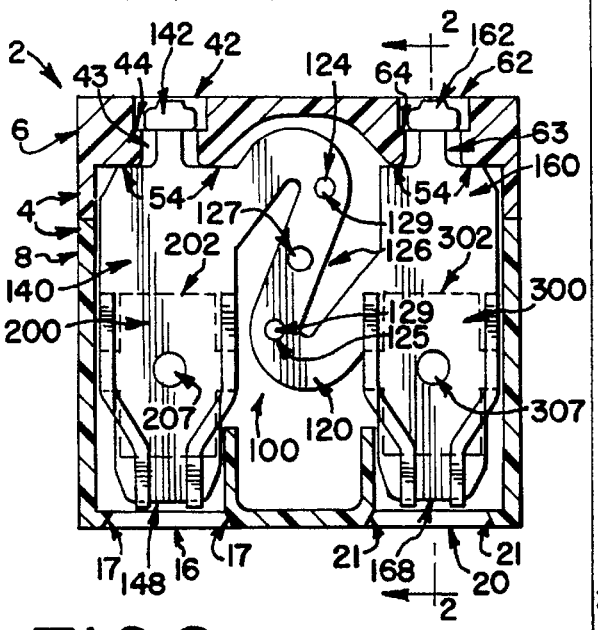
FIG. 1 is a cross-sectional front view of one embodiment of the female fuse assembly of the present invention.

The female fuse assembly 2 of FIGS. 1, 2, 3, and 4 generally includes a fuse housing 4, a female fuse element 100, a first female clip 200, and a second female clip 300. The female fuse element 100 includes a fuse link 120, a first fuse-link terminal 140, and a second fuse-link terminal 160. The housing 4 is made of electrically insulating material such as a synthetic polymer or plastic. The housing 4 generally encompasses the first and second fuse-link terminals 140, 160, the fuse link 120, and the first and second clips 200, 300 within the space therein. The housing 4 has an top half 6, and a bottom half 8, and each half 6, 8 can be molded to define a series of cavities or spaces therein for receiving the fuse element 100 and the clips 200, 300. The bottom half 8 of the housing 4 includes a plurality of snap-on cavities 9 which are adapted to receive a respective plurality of snap-on notches 10, which are located on the top half 6 of the housing 4 for engagement between the top half 6 and the bottom half 8 of the housing 4. The top half 6 of the housing 4 further includes a first tab opening 42 and a second tab opening 62. The tab openings 42, 62 each have an aperture 43, 63 through which respective tabs 142, 162 of the respective first and second fuse-link terminals 140, 160 fit therethrough. The tab openings 42, 62 also each have a ledge 44, 64 for a snug engagement with the tabs 142, 162 when the tabs 142, 162 are twisted thereon. This snug engagement occurs partly due to a plurality of shoulders 54, created by the cavities or spaces within the top half 6 of the housing 4, contacting the first and second fuse-link terminals 140, 160 as shown in FIG. 1.

Figure 2:
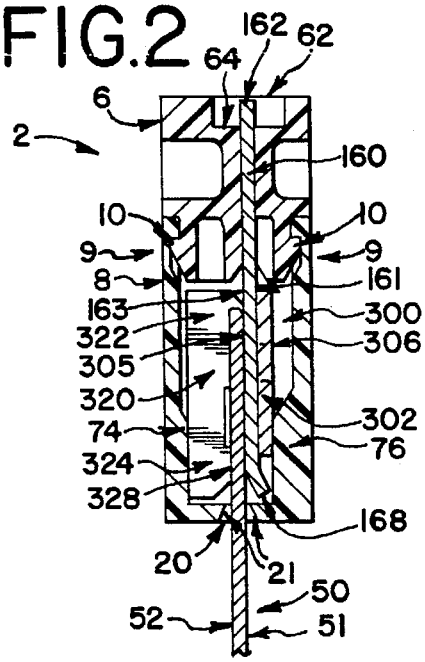
FIG. 2 is a cross-sectional side view taken along line 2—2 from FIG. 1, of the embodiment from FIG. 1 of the present invention additionally showing a male terminal inserted therein.
Figure 4:
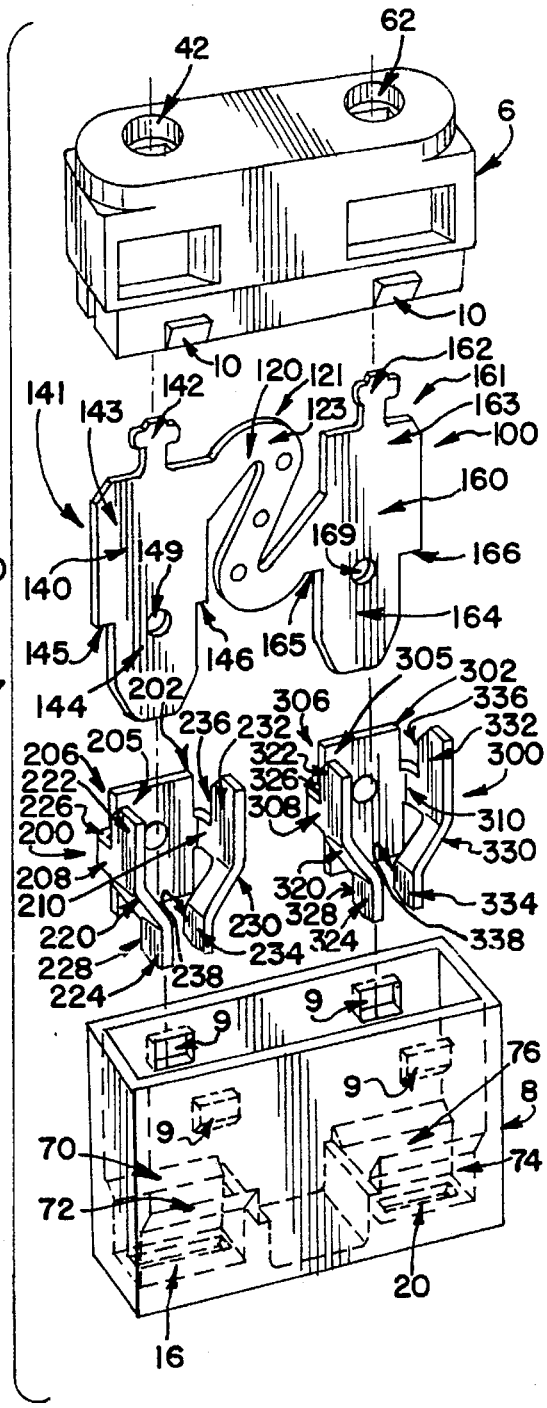
FIG. 4 is an exploded perspective view of the embodiment of FIG. 1 of the present invention.
Figure 5:
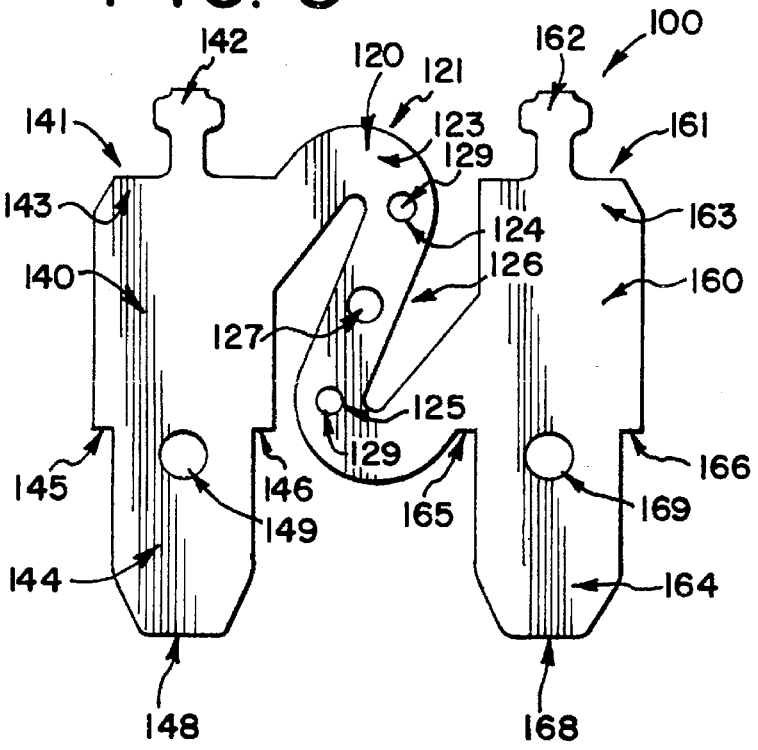
FIG. 5 is a front view of only the fuse element of the embodiment of FIG. 1 of the present invention.

The bottom half 8 of the housing 4 further includes a first male terminal opening 16 and a second male terminal opening 20, each for accepting a male terminal therein. Specifically, FIG. 2 depicts a male terminal 50 inserted into the second male terminal opening 20. Each male terminal opening 16, 20 has a set of respective bevelled edges 17, 21 for ease of insertion of a male terminal 50 into the male terminal openings 16, 20.

The first and the second fuse-link terminals 140, 160 of the fuse element 100 each have a first side 141, 161 and a second opposite side 143, 163, respectively. Each fuse-link terminal 140, 160 is secured within the space in the housing 4 partly through the tabs 142, 162, the openings 42, 62, and the shoulders 54 as described above, along with other features as will be described below. The fuse-link terminals 140, 160 also each include a clip-receiving portion 144,164, a first clip abutment 145, 165, and a second clip abutment 146, 166, respectively.

The fuse link 120 of the fuse element 100 is connected between the first fuse-link terminal 140 and the second fuse-link terminal 160. The fuse link 120 includes a fuse blowing portion at a central location thereof for interrupting a current flowing through the circuit upon certain high current or over current conditions, as will be described in greater detail below.

Figure 7:
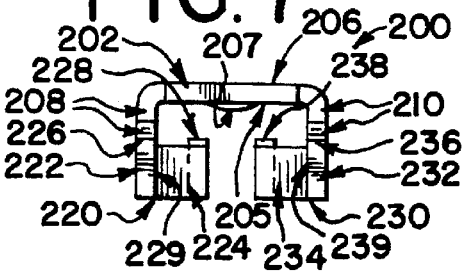
FIG. 7 is a top view of the clip from FIG. 6 of the present invention.
Figure 8:
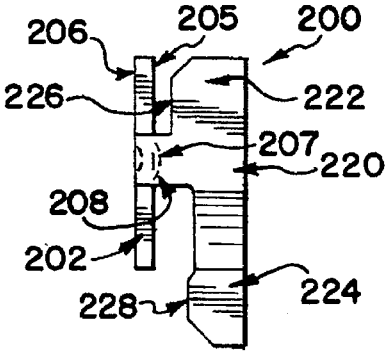
FIG. 8 is a side view of the clip from FIG. 6 of the present invention.
Figure 6:
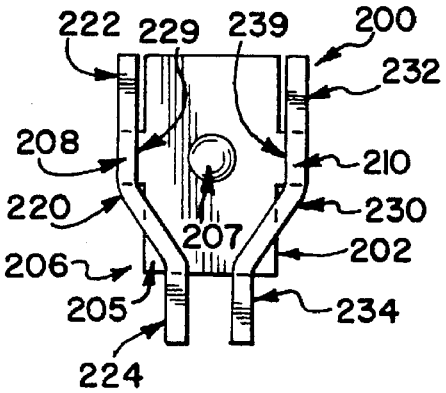
FIG. 6 is a front view of only one clip of the embodiment of FIG. 1 of the present invention.

Referring also to FIGS. 6, 7, and 8, the first female clip 200 of the female fuse assembly 2 is designed to connect the first fuse-link terminal 140 to a male terminal 50 while maintaining a snug fit for a prolonged period of commercial use of the female fuse assembly 2. The first clip 200 is preferably made of a resilient material such as steel. More specifically, the first female clip 200 includes a clip body 202 which has a first side 205 and a second side 206. The first side 205 of the first clip body 202 of the first clip 200 confronts the first side 141 of the first fuse-link terminal 140. The first clip 200 also includes a first arm-connecting extension 208, a second arm-connecting extension 210, a first arm 220, and a second arm 230. One end of each of the first and second arm-connecting extensions 208, 210 of the first clip 200 is connected to the clip body 202 of the first clip 200. The other ends of the first and second arm-connecting extensions 208, 210 of the first clip 200 are connected to the respective first and second arms 220, 230 of the first clip 200. The first and second arms 220, 230 are spaced away from and partially confront the first side 205 of the first clip body 202 of the first clip 200 when the first fuse-link terminal 140 is separated from the first clip 200. When the first fuse-link terminal 140 is engaged with and connected to the first clip 200, the first and second arms 220, 230 of the first clip 200 are also spaced away from and confront the second side 143 of the first fuse-link terminal 140. The spaced relation between the first and second arms 220, 230 of the first clip 200 and the first fuse-link terminal 140 define a male terminal-receiving slot therebetween for accepting a male terminal 50. FIG. 2 shows the same arrangement for a male terminal-receiving slot for the second clip 300, as it is representative of the arrangement with the first clip 200, with the male terminal 50 inserted therein.

Additionally, when the first fuse-link terminal 140 is inserted into and engaged with the first clip 200, the first and second arm-connecting extensions 208, 210 of the first clip 200 are engaged with the respective first and second clip abutments 145, 146 of the first fuse-link terminal 140. This engagement assists in holding the first clip 200 snug with the first terminal 140 and in the same position or place.

Again, the first female clip 200 is designed to accept a male terminal 50 and the first female clip 200 includes a clip body 202 adapted to accept the first fuse-link terminal 140. Specifically, the clip body 202 of the first clip 200 has a first side 205 which is adapted to contact and accept the first side 141 of the first fuse-link terminal 140. The first and second arm-connecting extensions 208, 210 of the first clip 200 are adapted to accept a male terminal 50, and the first and second arm-connecting extensions 208, 210 are also adapted to accept the first fuse-link terminal 140 in the following manner. The first and second arms 220, 230 of the first clip 200 each include a first branch 222, 232, and a second branch 224, 234, respectively. The first branches 222, 232 of the first and second arms 220, 230 of the first clip 200 each has a fuse-link terminal accepting edge 226, 236 which are adapted to accept and engage the first fuse-link terminal 140 when the first fuse-link terminal 140 is inserted into the first clip 200. The first side 205 of the clip body 202 of the first clip 200, the fuse-link terminal accepting edges 226, 236 of the first clip 200, and the arm-connecting extensions 208, 210 of the first clip 200 define a first fuse-link accepting slot for accepting the first fuse-link terminal 140 in order to secure a snug fit between the first fuse-link terminal 140 and the first clip 200. The first fuse-link terminal 140 is inserted into the first fuse-link terminal accepting slot to secure a snug fit of the first fuse-link terminal 140 therein. In use, a snug fit is created by the first fuse-link terminal accepting slot accepting, and having inserted therein, the first fuse-link terminal 140. In addition, the second branches 224, 234 of the first and second arms 220, 230 of the first clip 200 each have a male terminal accepting edge 228, 238 which are adapted to accept and resiliently engage the contacting surface 52 of a male terminal 50, similarly as shown in FIG. 2. In addition, the first and second arm-connecting extensions 208, 210 of the first clip 200 each include an engagement surface 229, 239 (FIGS. 6 and 7) for accepting and engaging the edges of the male terminal 50. The second side 143 of the first fuse-link terminal 140 inserted into the first clip 200, the male terminal accepting edges 228, 238 of the first clip 200 in spaced confronting relation to the second side 143 of the inserted first fuse-link terminal 140 as described above, and the engagement surfaces 229, 239 of the first clip 200 all define a first male terminal accepting slot for accepting and engaging the male terminal 50. Thus, the male terminal 50 is secured with a snug fit between the first fuse-link terminal 140 and the first clip 200. Thus, the clip-receiving portion 144 of the first fuse-link terminal 140 directly contacts the contact surface 51 of the male terminal 50 (see FIG. 2) in response to force exerted on the male terminal 50 by the first and second arms 208, 210 of the first clip 200.

For additional, but unnecessary, securement of the first clip 200 to the first fuse-link terminal 140, to achieve an even better snug fit, the first clip 200 can additionally include a dome 207 on the clip body 202 of the first clip 200. The dome 207 protrudes outwardly from the first side 205 of the clip body 202 of the first clip 200. The dome 207 of the first clip 200 will securely engage a first dome opening 149 in the clip-receiving portion 144 of the first fuse-link terminal 140 when the first fuse-link terminal 140 is inserted into the first clip 200. The first dome opening 149 is also used for movement of the overall fuse element through the manufacturing process. However, the dome 207 is unnecessary and may create additional cost in the manufacturing process.

Alternatively, or together with the dome 207, the first fuse-link terminal 140 can be bent to achieve an even better secured and snug fit with the first clip 200. Specifically, the first fuse-link terminal 140 further includes a contact end 148 on the clip-receiving portion 144 thereof. The contact end 148 of the first fuse-link terminal 140 is generally bowed in the direction of the first side 141 of the first fuse-link terminal 140 to further reduce the any probability of the first clip 200 from disengaging from the first fuse-link terminal 140. The bending takes place after the first fuse-link terminal 140 is inserted into the first clip 200. However, the bend is unnecessary to achieve a snug fit, and may add additional cost to the manufacturing process.

Referring again to FIGS. 6, 7, and 8, but only for the purpose of similarity, as well as to the other FIGS. 1, 2, 3, 4, and 5, the second female clip 300 of the female fuse assembly 2 is designed to connect the second fuse-link terminal 160 to a male terminal 50 while maintaining a snug fit for a prolonged period of commercial use of the female fuse assembly 2. The second clip 300 is preferably made of a resilient material such as steel. More specifically, the second female clip 300 includes a second clip body 302 which has a first side 305 and a second side 306. The first side 305 of the second clip body 302 of the second clip 300 confronts the first side 161 of the second fuse-link terminal 160. The second clip 300 also includes a first arm-connecting extension 308, a second arm-connecting extension 310, a first arm 320, and a second arm 330. One end of each of the first and second arm-connecting extensions 308, 310 of the second clip 300 is connected to the clip body 302 of the second clip 300. The other end of the first and second arm-connecting extensions 308, 310 of the second clip 300 are connected to the respective first and second arms 320, 330 of the second clip 300. The first and second arms 320, 330 are spaced away from and partially confront the first side 305 of the second clip body 302 of the second clip 300 when the second fuse-link terminal 160 is separated from the second clip 300. When the second fuse-link terminal 160 is engaged with and connected to the second clip 300, the first and second arms 320, 330 of the second clip 300 are also spaced away from and confront the second side 163 of the second fuse-link terminal 160. The spaced relation between the first and second arms 320, 330 of the second clip 300 and the second fuse-link terminal 160 define a male terminal-receiving slot therebetween for accepting a male terminal 50. FIG. 2 shows the arrangement for the male terminal-receiving slot for the second clip 300 with the male terminal 50 inserted therein.

Additionally, when the second fuse-link terminal 160 is inserted into and engaged with the second clip 300, the first and second arm-connecting extensions 308, 310 of the second clip 300 are engaged with the respective first and second clip abutments 165, 166 of the second fuse-link terminal 160. This engagement assists in holding the second clip 300 snug with the second terminal 160 and in the same position or place.

Again, the second female clip 300 is designed to accept a male terminal 50 and the second female clip 300 includes a clip body 302 adapted to accept the second fuse-link terminal 160. Specifically, the clip body 302 of the second clip 300 has a first side 305 which is adapted to contact and accept the first side 161 of the second fuse-link terminal 160. The first and second arm-connecting extensions 308, 310 of the second clip 300 are adapted to accept a male terminal 50, and the first and second arm-connecting extensions 308, 310 are also adapted to accept the second fuse-link terminal 160 in the following manner. The first and second arms 330, 330 of the second clip 300 each include a first branch 322, 332, and a second branch 324, 334, respectively. The first branches 322, 332 of the first and second arms 320, 330 of the second clip 300 each has a fuse terminal accepting edge 326, 336 which are adapted to accept and engage the second fuse-link terminal 160 when the second fuse-link terminal 160 is inserted into the second clip 300. The first side 305 of the clip body 302 of the second clip 300, the fuse-link accepting edges 326, 336 of the second clip 300, and the arm-connecting extensions 308, 310 of the second clip 300 define a second fuse-link accepting slot for accepting the second fuse-link terminal 160 in order to secure a snug fit between the second fuse-link terminal 160 and the second clip 300. The second fuse-link terminal 160 is inserted into the second fuse-link terminal accepting slot to secure a snug fit of the second fuse-link terminal 160 therein. In use, a snug fit is created by the second fuse-link terminal accepting slot accepting, and having inserted therein, the second fuse-link terminal 160. In addition, the second branches 324, 334 of the first and second arms 320, 330 of the second clip 300 each have a male terminal accepting edge 328, 338 which are adapted to accept and resiliently engage the contacting surface 52 of the male terminal 50 as shown in FIG. 2. In addition, the first and second arm-connecting extensions 308, 310 of the second clip 300 each include an engagement surface 329, 339 (similarly as in FIGS. 6 and 7) for accepting and engaging the edges of the male terminal 50. The second side 163 of the second fuse-link terminal 160 inserted into the second clip 300, the male terminal accepting edges 328, 338 of the second clip 300 in spaced confronting relation to the second side 163 of the inserted second fuse-link terminal 160 as described above, and the engagement surfaces 329, 339 of the second clip 300 all define a second male terminal accepting slot for accepting and engaging the male terminal 50. Thus, the male terminal 50 is secured with a snug fit between the second fuse-link terminal 160 and the second clip 300. Thus, the clip-receiving portion 164 of the second fuse-link terminal 160 directly contacts the contact surface 51 of the male terminal 50 (FIG. 2) in response to force exerted on the male terminal 50 by the first and second arms 308, 310 of the second clip 300.

For additional, but unnecessary, securement of the second clip 300 to the second fuse-link terminal 160 to achieve an even better snug fit, the second clip 300 can additionally include a dome 307 on the clip body 302 of the second clip 300. The dome 307 protrudes outwardly from the first side 305 of the clip body 302 of the second clip 300. The dome 307 of the second clip 300 will securely engage a second dome opening 169 in the clip-receiving portion 164 of the second fuse-link terminal 160 when the second fuse-link terminal 160 is inserted into the second clip 300. The second dome opening 169 is also used for movement of the overall fuse element through the manufacturing process. However, the dome 307 is unnecessary and may create additional cost in the manufacturing process.

Alternatively, or together with the dome 307, the second fuse-link terminal 160 can be bent to achieve an even better secured and snug fit with the second clip 300. Specifically, the second fuse-link terminal 160 further includes a contact end 168 on the clip-receiving portion 164 thereof. The contact end 168 of the second fuse-link terminal 160 is generally bowed in the direction of the first side 161 of the second fuse-link terminal 160, as shown in FIG. 2 to further reduce the any probability of the second clip 300 from disengaging from the second fuse-link terminal 160. The bending takes place after the second fuse-link terminal 160 is inserted into the second clip 300. However, the bend is unnecessary to achieve a snug fit, and may add additional cost to the manufacturing process.

Another feature of the present invention includes the following. The fuse housing 4 additionally includes a first stabilizer 70 and a second stabilizer 72 related to the first fuse-link terminal 140 and first clip 200, and a first stabilizer 74 and a second stabilizer 76 related to the second fuse-link terminal 160 and second clip 300. The stabilizers 70, 72, 74, 76 are all located within the bottom portion 8 of the housing 4 as is shown in FIG. 2 for the first and second stabilizers 74, 76 related to the second fuse-link terminal 160 and second clip 300. The first stabilizer 70, related to the first fuse-link terminal 140 and first clip 200, contacts and secures the first and second arms 220, 230 of the first clip 200 for stabilizing the first fuse-link terminal 140 and first clip 200 within the housing. Likewise, the first stabilizer 74, related to the second fuse-link terminal 160 and second clip 300, contacts and secures the first and second arms 320, 330 of the second clip 300 for stabilizing the second fuse-link terminal 160 and second clip 300 within the housing. The second stabilizer 72, related to the first fuse-link terminal 140 and first clip 200, contacts and secures the second side 206 of the first clip body 202 of the first clip 200 for stabilizing the first fuse-link terminal 140 and first clip 200 within the housing. Likewise, the second stabilizer 76, related to the second fuse-link terminal 160 and second clip 300, contacts and secures the second side 306 of the second clip body 302 of the second clip 300 for stabilizing the second fuse-link terminal 160 and second clip 300 within the housing.

In one particular embodiment of the present invention, the present invention not being limited to such an arrangement, the first and second sides 141, 161, 143, 163 of the first and second fuse-link terminals 140, 160 are generally co-planar. The first and second sides 121, 131 of the fuse link 120 and the first and second sides 141, 161, 143, 163 of the first and second fuse-link terminals 140, 160 are also generally co-planar with one another in this particular embodiment. Furthermore, a first clip 200 is adapted to receive a male terminal 50 in a plane parallel to the plane of the first fuse-link terminal 140. Within this particular embodiment, the first clip 200 need not be a separate element from the first fuse-link terminal 140 and can be a called first clip portion in place thereof. However, the first clip 200 can also be a separate element adapted for attachment to the first fuse-link terminal 140. Likewise, a second clip 300 is adapted to receive a male terminal 50 in a plane parallel to the plane of the second fuse-link terminal 160. Within this particular embodiment, the second clip 300 need not be a separate element from the second fuse-link terminal 160 and can be a called second clip portion in place thereof. However, the second clip 300 can also be a separate element adapted for attachment to the second fuse-link terminal 160.

As previously described, the housing 4 includes a first tab opening 42 and a second tab opening 62. For engagement with these openings 42, 62, and for continuity checking of the fuse element 100, the first fuse-link terminal 140 further includes a first tab 142 which is exposed to the exterior of the housing 4 through the first tab opening 42 when the fuse element 100 is placed within the housing 4. For the same purposes, the second fuse-link terminal 160 includes a second tab 162 which is exposed to the exterior of the housing 4 through the second tab opening 62 when the fuse element 100 is placed within the housing 4. The first tab 142 is twisted on the ledge 44 of first tab opening 42, and is exterior to the first tab aperture 43 of the first tab opening 42 when the fuse element 100 is placed within the housing 4. Likewise, the second tab 162 is twisted on the ledge 64 of second tab opening 62, and is exterior to the second tab aperture 63 of the second tab opening 62 when the fuse element 100 is placed within the housing 4.

As described in U.S. Pat. No. 4,635,023 (Oh), entitled "Fuse Assembly Having a Non-Sagging Suspended Fuse Link", which is incorporated herein as a part of the present specification by reference, the fuse blowing portion of the fuse link in FIGS. 1, 4, and 5, includes a hot spot portion 126, and a fuse blowing current-reducing material 129 spaced apart from and on opposite sides of the hot-spot portion 126. The fuse link 120 also includes a first opening 124 and a second opening 125. Each opening 124, 125 is on opposite sides of the hot spot portion 126, and the fuse blowing current-reducing material 129 is in the form of a pair of plugs installed in the openings 124, 125. The fuse blowing current-reducing material 129 within the openings 124, 125 is preferably equally spaced apart on opposite sides of the hot-spot portion 126. The hot-spot portion includes a central opening 127 as is described in the Oh patent identified above. In addition, the fuse link 120 of the embodiment in FIGS. 1, 4, and 5 has a length greater than the distance between the first fuse-link terminal 140 and the second fuse-link terminal 160, and the fuse link 120 is "S" shaped, but these configurations are not limited thereto. The first and second fuse-link terminals 140, 160, and the fuse link 120 are preferably made of a zinc alloy. In addition, the fuse-blowing current reducing material 129 is preferably tin.

It will be understood that the specific dimensions of the fuse-link terminals 140,160, and the clips 200,300 are dependent on the dimensions of the male terminals on the terminal blocks, and designing the specific dimensions of female fuse elements for interaction with one another and with spaced apart male terminals is well known.

It will also be understood that the invention may be embodied in other specific forms without departing from the spirit or central characteristics thereof, including, but not limited to, the orientations of the invention elements herein. The present examples and embodiments, therefore, are to be considered in all respects as illustrative and not restrictive, and the invention is not to be limited to the details given herein.

What is claimed is:

1. A female fuse assembly for interrupting a current flowing through a circuit upon certain high current conditions, the circuit including male terminals each having opposed contact surfaces for conductively connecting the female fuse assembly to the rest of the circuit, the female fuse assembly comprising:

a fuse housing made of electrically insulating material and having a space therein;

a first and a second fuse-link terminal each having a first side and a second opposite side, each fuse-link terminal being secured in the housing space and including a clip-receiving portion, a first clip abutment, and a second clip abutment;

a fuse-link connected between the first fuse-link terminal and the second fuse-link terminal, the fuse link including a fuse blowing portion;

a first female clip for connecting the first fuse-link terminal to a male terminal, the first female clip including a clip body for confronting the first side of the first fuse-link terminal, a first and a second arm-connecting extension, and a first and a second arm in spaced confronting relation to the second side of the first fuse-link terminal to define a male terminal-receiving slot therebetween, the first and second arm-connecting extensions of the first clip being engaged with the respective first and second clip abutments of the first fuse-link terminal for holding the first clip in place, one end of each of the first and second arm-connecting extensions of the first clip being connected to the clip body of the first clip, and the other end of the first and second arm-connecting extensions of the first clip being connected to the respective first and second arms, the first and second arms of the first clip for resiliently engaging the contacting surface of the male terminal; and, a second female clip for connecting the second fuse-link terminal to a male terminal, the second female clip including a clip body for confronting the first side of the second fuse-link terminal, a first and a second arm-connecting extension, and a first and a second arm in spaced confronting relation to the second side of the second fuse-link terminal to define a second male terminal-receiving slot therebetween, the first and second arm-connecting extensions of the second clip being engaged with the respective first and second clip abutments of the second fuse-link terminal for holding the second clip in place, one end of each of the first and second arm-connecting extensions of the second clip being connected to the clip body of the second clip, and the other end of the first and second arm-connecting extensions of the second clip being connected to the respective first and second arms, the first and second arms of the second clip for resiliently engaging the contacting surface of the male terminal.

2. A female fuse assembly for interrupting a current flowing through a circuit upon certain high current conditions, the circuit including male terminals each having opposed contact surfaces for conductively connecting the female fuse assembly to the rest of the circuit, the female fuse assembly comprising:

a fuse housing made of electrically insulating material and having a space therein;

a first and a second fuse-link terminal each having a first side and a second opposite side, each fuse-link terminal being secured in the housing space and including a clip-receiving portion;

a fuse link connected between the first fuse-link terminal and the second fuse-link terminal, the fuse link including fuse blowing portion;

a first female clip for connecting the first fuse-link terminal to a male terminal, the first female clip including a clip body for confronting the first side of the first fuse-link terminal, a first and a second arm-connecting extension, and a first and a second arm, one end of each of the first and second arm-connecting extensions of the first clip being connected to the clip body of the first clip, and the other end of the first and second arm-connecting extensions being connected to the respective first and second arms, the first and second arms of the first clip for resiliently engaging the contacting surface of a male terminal; and, a second female clip for connecting the second fuse-link terminal to a male terminal, the second female clip including a clip body for confronting the first side of the second fuse-link terminal, a first and a second arm-connecting extension, and a first and a second arm, one end of each of the first and second arm-connecting extensions of the second clip being connected to the clip body of the second clip, and the other end of the first and second arm-connecting extensions being connected to the respective first and second arms, the first and second arms of the second clip for resiliently engaging the contacting surface of a male terminal, wherein the first and second arms of the first clip each include a first branch and a second branch, the first branches of the first and second arms of the first clip engaging the second side of the first fuse-link terminal to secure a snug fit between the first fuse-link terminal and the first clip, and wherein the first and second arms of the second clip each include a first branch and a second branch, the first branches of the first and second arms of the second clip engaging the second side of the second fuse-link terminal to secure a snug fit between the second fuse-link terminal and the second clip.

3. A female fuse assembly for interrupting a current flowing through a circuit upon certain high current conditions, the circuit including male terminals having opposed contacting surfaces for conductively connecting the female fuse assembly to the rest of the circuit, the female fuse assembly comprising:

a fuse housing made of electrically insulating material and having a space therein;

a first and a second fuse-link terminal each having a first side and a second opposite side, each fuse-link terminal being secured in the housing space, wherein the first and second sides of the first and second fuse-link terminals are generally co-planar;

a fuse link connected between the first fuse-link terminal and the second fuse-link terminal, the fuse link including a first side, a second side, and a fuse blowing portion, wherein the first and second sides of the fuse link and the first and second sides of the first and second fuse-link terminals are generally co-planar;

a first female clip portion for connecting the first fuse-link terminal to a male terminal, the first female clip portion including a first arm and a second arm, the first and second arms of the first clip portion for resiliently engaging a male terminal, wherein the first clip portion is adapted to receive a male terminal in a plane parallel to the plane of the first fuse-link terminal; and, a second female clip portion for connecting the second fuse-link terminal to a male terminal, the second female clip portion including a first arm and a second arm, the first and second arms of the second clip portion for resiliently engaging a male terminal, wherein the second clip portion is adapted to receive a male terminal in a plane parallel to the plane of the second fuse-link terminal.

4. The female fuse assembly as claimed in claim 3 wherein the first clip portion is a first clip adapted for attachment to the first fuse-link terminal as a separate element, and the second clip portion is a second clip adapted for attachment to the second fuse-link terminal as a separate element.

5. The female fuse assembly as claimed in claim 4 wherein the first fuse-link terminal further includes a first clip abutment and a second clip abutment, wherein the second fuse-link terminal further includes a first clip abutment and a second clip abutment, wherein the first clip further includes a first arm-connecting extension, a second arm-connecting extension, the first and second arm-connecting extensions of the first clip being engaged with the respective first and second clip abutments of the first fuse-link terminal, and wherein the second clip further includes a first arm-connecting extension and a second arm-connecting extension, the first and second arm-connecting extensions of the second clip being engaged with the respective first and second clip abutments of the second fuse-link terminal.

6. The female fuse assembly as claimed in claim 5 wherein the first and second fuse-link terminals each further include a clip-receiving portion, wherein the first and second clips each further include a clip body, a first arm, and a second arm, one end of each of the first and second arm-connecting extensions of the first clip being connected to the clip body of the first clip, and the other end of the first and second arm-connecting extensions of the first clip being connected to the respective first and second arms of the first clip, and one end of each of the first and second arm-connecting extensions of the second clip being connected to the clip body of the second clip, and the other end of the first and second arm-connecting extensions of the second clip being connected to the respective first and second arms of the second clip.

7. The female fuse assembly as claimed in claim 1, wherein the clip-receiving portion of the first fuse-link terminal directly contacts the contact surface of a male terminal in response to force exerted on the male terminal by the first and second arms of the first clip, and wherein the clip-receiving portion of the second fuse-link terminal directly contacts the contact surface of a male terminal in response to force exerted on the male terminal by the first and second arms of the second clip.

8. The female fuse assembly as claimed in claim 1 wherein the first and second arms of the first clip are adapted for engaging the first fuse-link terminal to secure a snug fit between the first fuse-link terminal and the first clip, and wherein the first and second arms of the second clip are also adapted for engaging the second fuse-link terminal to secure a snug fit between the second fuse-link terminal and the second clip.

9. The female fuse assembly as claimed in claim 1 or 6 wherein the first and second arms of the first clip each include a first branch and a second branch, the first branches of the first and second arms of the first clip adapted for engaging the second side of the first fuse-link terminal to secure a snug fit between the first fuse-link terminal and the first clip, and wherein the first and second arms of the second clip each include a first branch and a second branch, the first branches of the first and second arms of the second clip adapted for engaging the second side of the second fuse-link terminal to secure a snug fit between the second fuse-link terminal and the second clip.

10. The female fuse assembly as claimed in claim 9 wherein the second branches of the first and second arms of the first clip are adapted for resiliently engaging a male terminal, and wherein the second branches of the first and second arms of the second clip are adapted for resiliently engaging a male terminal.

11. The female fuse assembly as claimed in claim 2 wherein the second branches of the first and second arms of the first clip are adapted for resiliently engaging a male terminal, and wherein the second branches of the first and second arms of the second clip are adapted for resiliently engaging a male terminal.

12. The female fuse assembly as claimed in claim 1, 2, or 6, wherein the first and the second clip body each include a first and a second side, the first clip including a dome on the clip body of the first clip protruding outwardly from the first side of the clip body, the dome of the first clip engaging a first dome opening in the clip-receiving portion of the first fuse-link terminal, and wherein the second clip includes a dome on the clip body of the second clip protruding outwardly from the first side of the clip body, the dome of the second clip engaging a second dome opening in the clip-receiving portion of the second fuse-link terminal.

13. The female fuse assembly as claimed in claim 1, 2, or 3, wherein the housing includes a first tab opening having a first tab aperture, and a second tab opening having a second tab aperture, wherein the first fuse-link terminal includes a first tab exposed to the exterior of the housing through the first tab opening, and wherein the second fuse-link terminal includes a second tab exposed to the exterior of the housing through the second tab opening.

14. The female fuse assembly as claimed in claim 13 wherein the first tab is twisted exterior of the first tab aperture, and wherein the second tab is twisted exterior of the second tab aperture.

15. The female fuse assembly as claimed in claim 1, 2, or 4, wherein the first fuse-link terminal further includes a contact end on the clip-receiving portion thereof, the contact end of the first fuse-link terminal being generally bowed in the direction of the first side of the first fuse-link terminal, and wherein the second fuse-link terminal further includes a contact end on the clip-receiving portion thereof, the contact end of the second fuse-link terminal being generally bowed in the direction of the first side of the second fuse-link terminal.

16. The female fuse assembly as claimed in claim 1, 2, or 3 wherein the first and second clips are made of a resilient material.

17. A female fuse assembly for interrupting a current flowing through a circuit upon certain high current conditions, the circuit including male terminals having opposed contacting surfaces for conductively connecting the female fuse assembly to the rest of the circuit, the female fuse assembly comprising:

a first female clip for accepting a male terminal, the first female clip including a clip body adapted to accept a first fuse-link terminal, the clip body of the first clip having a first side and a second side, a first and a second arm-connecting extension adapted to accept the first fuse-link terminal, and a first and a second arm, one end of each of the first and second arm-connecting extensions of the first clip being connected to the clip body of the first clip, and the other end of the first and second arm-connecting extensions of the first clip being connected to the respective first and second arms of the first clip, wherein the first and second arms of the first clip each include a first branch and a second branch, the first branches of the first and second arms of the first clip each having a fuse terminal accepting edge adapted to accept the first fuse-link terminal, wherein the first side of the clip body of the first clip, the fuse-link accepting edges of the first clip, and the arm-connecting extensions of the first clip define a first fuse-link accepting slot for accepting the first fuse-link terminal to secure a snug fit between the first fuse-link terminal and the first clip;

a second female clip for accepting a male terminal, the second female clip including a clip body adapted to accept a second fuse-link terminal, the clip body of the second clip having a first side and a second side, a first and a second arm-connecting extension adapted to accept the second fuse-link terminal, and a first and a second arm, one end of each of the first and second arm-connecting extensions of the second clip being connected to the clip body of the second clip, and the other end of the first and second arm-connecting extensions of the second clip being connected to the respective first and second arms of the second clip, wherein the first and second arms of the second clip each include a first branch and a second branch, the first branches of the first and second arms of the second clip each having a fuse terminal accepting edge adapted to accept the second fuse-link terminal, wherein the first side of the clip body of the second clip, the fuse-link accepting edges of the second clip, and the arm-connecting extensions of the second clip define a second fuse-link accepting slot for accepting the second fuse-link terminal to secure a snug fit between the second fuse-link terminal and the second clip;

a first fuse-link terminal for insertion into the first fuse-link terminal accepting slot to secure the first fuse-link terminal therein;

a second fuse-link terminal for insertion into the second fuse-link terminal accepting slot to secure the second fuse-link terminal therein; and, a fuse link connected between the first fuse-link terminal and the second fuse-link terminal.

18. A female fuse assembly for interrupting a current flowing through a circuit upon certain high current conditions, the circuit including male terminals having opposed contacting surfaces for conductively connecting the female fuse assembly to the rest of the circuit, the female fuse assembly comprising:

a first and a second fuse-link terminal each having a first side and a second side;

a fuse link connected between the first fuse-link terminal and the second fuse-link terminal.

a first female clip for accepting a male terminal, the first female clip including a clip body, the clip body of the first clip having a first side adapted to contact the first side of the first fuse-link terminal, having a second side, having a first and a second arm-connecting extension adapted to accept a male terminal, and having a first and a second arm, one end of each of the first and second arm-connecting extensions of the first clip being connected to the clip body of the first clip, and the other end of the first and second arm-connecting extensions of the first clip being connected to the respective first and second arms of the first clip, wherein the first and second arms of the first clip each include a first branch and a second branch, the second branches of the first and second arms of the first clip each having a male terminal accepting edge adapted to accept and resiliently engage a male terminal, wherein the first and second arm-connecting extensions of the first clip each include an engagement surface for accepting a male terminal, wherein the second side of the first fuse-link terminal inserted into the first clip, the male terminal accepting edges of the first clip in spaced confronting relation to the second side of the inserted first fuse-link terminal, and the engagement surfaces of the first clip define a first male terminal accepting slot for accepting a male terminal and for securing a snug fit between a male terminal, the first fuse-link terminal, and the first clip;

a second female clip for accepting a male terminal, the second female clip including a clip body, the clip body of the second clip having a first side adapted to contact the first side of the second fuse-link terminal, having a second side, having a first and a second arm-connecting extension adapted to accept a male terminal, and having a first and a second arm, one end of each of the first and second arm-connecting extensions of the second clip being connected to the clip body of the second clip, and the other end of the first and second arm-connecting extensions of the second clip being connected to the respective first and second arms of the second clip, wherein the first and second arms of the second clip each include a first branch and a second branch, the second branches of the first and second arms of the second clip each having a male terminal accepting edge adapted to accept and resiliently engage a male terminal, wherein the first and second arm-connecting extensions of the second clip each include an engagement surface for accepting a male terminal, wherein the second side of the second fuse-link terminal inserted into the second clip, the male terminal accepting edges of the second clip in spaced confronting relation to the second side of the inserted second fuse-link terminal, and the engagement surfaces of the second clip define a second male terminal accepting slot for accepting a male terminal and for securing a snug fit between a male terminal, the second fuse-link terminal, and the second clip.

19. The female fuse assembly as claimed in claim 17 or 18 further including a fuse housing made of electrically insulating material and having a space therein, the fuse housing encompassing the first and second fuse-link terminals, the fuse link, and the first and second clips within the space therein.

* * * * *

UNITED STATES PATENT AND TRADEMARK OFFICE

CERTIFICATE OF CORRECTION

PATENT NO. : 5,668,521
DATED : September 16, 1997
INVENTOR(S) : Seibang Oh

It is certified that error appears in the above-identified patent and that said Letters Patent is hereby corrected as shown below:

Column 2, line 21, substitute the word "are" for the word "is".
Column 6, line 55, substitute the word "any" for the words "the any".
Column 7, line 47, substitute "320" for "330" after the word "arms" (first occurrence).

Column 9, line 23, substitute the words "called a" for the words "a called".
Column 9, line 31, substitute the words "called a" for the words "a called".

Signed and Sealed this

Tenth Day of March, 1998

Bruce Lehman

*Attest:*

BRUCE LEHMAN

*Attesting Officer*

*Commissioner of Patents and Trademarks*